US005314394A

United States Patent [19]

Ronan

[11] Patent Number: 5,314,394

[45] Date of Patent: May 24, 1994

[54] SPOTTING APPARATUS FOR ASSISTING A WEIGHTLIFTER

[76] Inventor: John J. Ronan, 15 Tremont St., Newburyport, Mass. 01950

[21] Appl. No.: 933,029

[22] Filed: Aug. 20, 1992

Related U.S. Application Data

[63] Continuation-in-part of Ser. No. 816,630, Dec. 31, 1991, abandoned.

[51] Int. Cl.[5] ..... A63B 21/078

[52] U.S. Cl. ..... 482/104; 482/1

[58] Field of Search ..... 482/1-9, 482/98, 99, 104, 106, 142, 108, 107, 93

[56] References Cited

U.S. PATENT DOCUMENTS

| | | | |
|---|---|---|---|
| 4,249,726 | 2/1981 | Faust . | |
| 4,253,662 | 3/1981 | Podolak . | |
| 4,256,301 | 3/1981 | Goyette . | |
| 4,324,398 | 4/1982 | Hole . | |
| 4,493,485 | 1/1985 | Jones . | |
| 4,527,797 | 7/1985 | Slade, Jr. et al. | 482/104 X |
| 4,540,171 | 9/1985 | Clark et al. . | |
| 4,635,930 | 1/1987 | Cormier . | |
| 4,687,195 | 8/1987 | Potts . | |
| 4,708,338 | 11/1987 | Potts . | |
| 4,726,582 | 2/1988 | Fulks | 482/5 |
| 4,746,113 | 5/1988 | Kissel | 482/99 |
| 4,795,149 | 1/1989 | Pearson | 482/98 |
| 4,799,672 | 1/1989 | Barrett . | |
| 4,807,875 | 2/1989 | Tanski . | |
| 4,815,746 | 3/1989 | Ward . | |
| 4,826,155 | 5/1989 | James . | |
| 4,875,676 | 10/1989 | Zimmer . | |
| 4,907,795 | 3/1990 | Shaw et al. . | |
| 4,934,693 | 6/1990 | Santoro | 482/98 |
| 4,949,959 | 8/1990 | Stevens . | |
| 4,998,721 | 3/1991 | Anders et al. . | |
| 5,015,926 | 5/1991 | Casler | 482/6 X |
| 5,040,787 | 8/1991 | Brotman . | |
| 5,048,826 | 9/1991 | Ryan . | |
| 5,147,263 | 9/1992 | Mueller | 482/99 X |
| 5,151,072 | 9/1992 | Cone et al. | 482/104 |
| 5,184,992 | 2/1993 | Banks | 482/104 |

FOREIGN PATENT DOCUMENTS

| | | | |
|---|---|---|---|
| 369915 | 11/1973 | U.S.S.R. | 482/106 |
| 1567225 | 5/1990 | U.S.S.R. . | |

*Primary Examiner*—Robert Bahr

*Attorney, Agent, or Firm*—Samuels, Gauthier & Stevens

[57] ABSTRACT

A weightlifting apparatus including a support structure for supporting a weight to be lifted, and a monitoring system for monitoring the position of the weight within a range of movement. The monitoring system includes sensors positioned within the range of movement, assisting unit for intermittently providing assistance, and a control unit for continuously controlling the assisting unit responsive to the outputs of the sensors. The apparatus is further capable of providing variable amounts of assistance.

11 Claims, 6 Drawing Sheets

SPOTTING APPARATUS FOR ASSISTING A WEIGHTLIFTER

This application is a continuation-in-part of application Ser. No. 07/816,630, filed Dec. 31, 1991, now abandoned.

BACKGROUND OF THE INVENTION

The invention relates to weightlifting apparatus such as those involving barbells with free-weights or those involving stacked weight machines. In particular, the invention relates to weightlifting apparatus which can be safely used without the aid of a spotter.

Weightlifting without a spotter on an apparatus which requires a spotter, is dangerous. For example, weightlifters often exercise by performing many repetitions of the same weight through a point of partial muscle failure. Since assistance must be provided to continue beyond the point of partial muscle failure, this exercise requires that a spotter be present at all times.

Conventional weightlifting apparatus which do not require the assistance of a spotter include apparatus which provide a power source to protect a user in response to a switch under the control of, and actuated by, the user (U.S. Pat. No. 4,253,662). Weightlifting apparatus which provide a power source to protect a user are superior to other weightlifting apparatus in their ability to safely protect an extremely fatigued weightlifter. Such prior art power assist apparatus, however, have the disadvantage that the extremely fatigued user must locate and actuate the user operated switch. If either of these activities (locating the switch or actuating the switch) cannot be accomplished, then the fatigued weightlifter is likely to be in serious danger.

Conventional weightlifting apparatus which provide automated safety capabilities include U.S. Pat. No. 4,807,875 to Tanski. Such apparatus typically take control of the weight being lifted once a trouble signal has been activated. Such apparatus, however, do not provide intermittent spotting capabilities to varying degrees allowing a weightlifter to continue performing many repetitions after muscle failure has occurred. A weightlifter may desire to continue performing a set of repetitions after he or she has needed assistance, even if he or she only contributes a small portion of the force needed to lift the weight each time. A person spotting such a weightlifter would be able to provide such intermittent spotting assistance. A weightlifting apparatus with automated safety capabilities, however, is not able to accomplish this.

It is therefore an objective of the present invention to provide for a power assist weightlifting apparatus which provides intermittent spotting capabilities, allowing a weightlifter to continue performing repetitions during partial muscle failure.

SUMMARY OF THE INVENTION

The invention provides for a power assist weightlifting apparatus which provides intermittent spotting capabilities. The apparatus of the invention is automated and does not rely on the user to locate or actuate a user operated switch.

The present invention involves a weightlifting apparatus which comprises a support structure for supporting a weight to be lifted, and a monitoring system for monitoring the position of a weight within a range of movement. The monitoring system includes sensors for sensing the position of the weight within a range of movement, an assisting unit for assisting in controlling the elevational movement of the weight, and a control system for controlling the assisting unit responsive to the outputs of the sensors.

The assisting unit provides intermittent assistance to varying degrees in lifting the weight, and it provides intermittent assistance in stopping the weight from falling too rapidly. The intermittently available assistance allows a user to continue lifting repetitions even when the user is supplying only a portion of the force required to lift the weight.

In the preferred embodiment the assisting unit includes a motor, a clutch, a brake, and a counterweight, and the control system includes a microprocessor.

BRIEF DESCRIPTION OF THE DRAWINGS

Other features and objects of the invention are further illustrated in the accompanying drawings in which.

DETAILED DESCRIPTION OF THE ILLUSTRATED EMBODIMENTS

Figure 1:
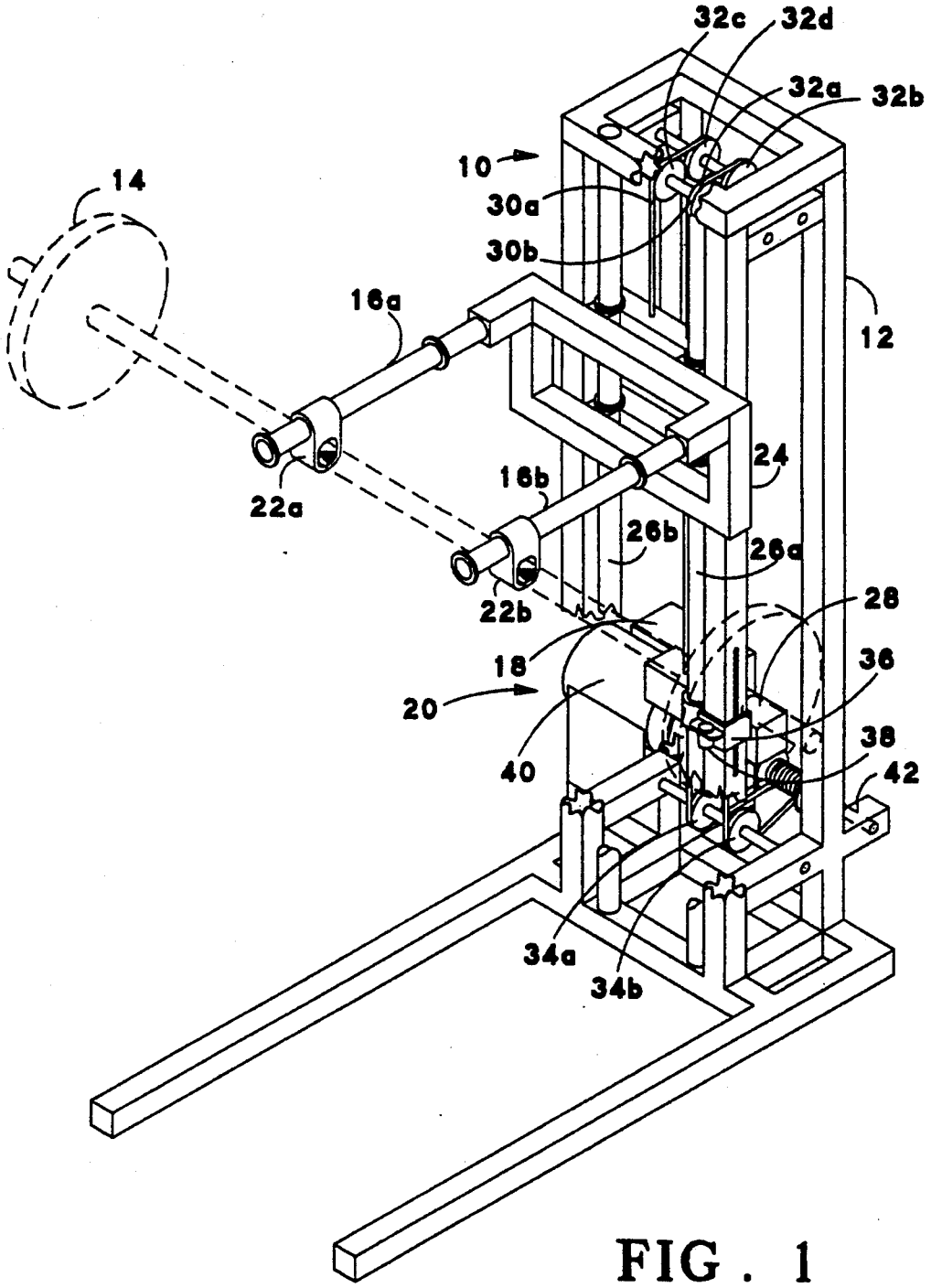
FIG. 1 is an isometric view of a first embodiment of a weightlifting apparatus of the present invention.

FIG. 1 shows an embodiment of a weightlifting apparatus 10 of the present invention. The apparatus 10 includes a support structure 12, a barbell 14, spotting arms 16*a* and 16*b*, a control unit 18, and a power assist unit 20.

The barbell 14 is supported by the spotting arms 16*a* and 16*b* through holding collars 22*a* and 22*b*, respectively. The holding collars 22*a* and 22*b* are horizontally slidable along the spotting arms 16*a* and 16*b*. The spotting arms 16 are supported by an arm support assembly 24 which moves along vertical shafts 26*a* and 26*b*. A counterweight 28 is connected to the arm support assembly 24. Counterweight 28 balances the gravitational force of the arm support assembly 24 so that a user is required to lift only the weight of the barbell. The arm support assembly 24 is connected to the power assist unit 20 via cables 30*a* and 30*b* threaded over pulleys 32*a*, 32*b*, 34*a*, and pulleys 32*c*, 32*d*, and 34*b*, respectively.

The barbell 14 is free to move vertically and horizontally within the following range of movement: the barbell 14, together with the holding collars 22*a* and 22*b*, is free to move along spotting arms 16*a* and 16*b*; and the barbell 14, together with the arm support assembly 24, is free to move along vertical shafts 26*a* and 26*b*.

A lower stop 36 is positioned along vertical shaft 26*a* such that the arm support assembly 24 comes into communication with the lower stop 36 when the barbell 14 is at a predetermined critical position. This critical position is set to be lower than the user would normally allow the barbell to fall. Thus if the barbell reaches this depth, the user is likely to be in need of assistance. A lower position sensor 38 is actuated responsive to the condition of whether the arm support assembly 24 is in communication with the lower stop 36.

Lower position sensor 38 is in electronic communication with control unit 18 which is in electrical communication with motor 40. If the lower position sensor 38 signals that arm support assembly 24 is in contact with lower stop 36 then the control unit 18 responds by controlling the power assist unit 20 to retract the cables 30*a*, 30*b*, thus causing the barbell 14 to be raised. The power assist unit 20 includes a motor 40 with a drive shaft 42 to which the ends of cables 30 are fixed, thus raising the arm support assembly 24 and the barbell 14.

Figure 2:
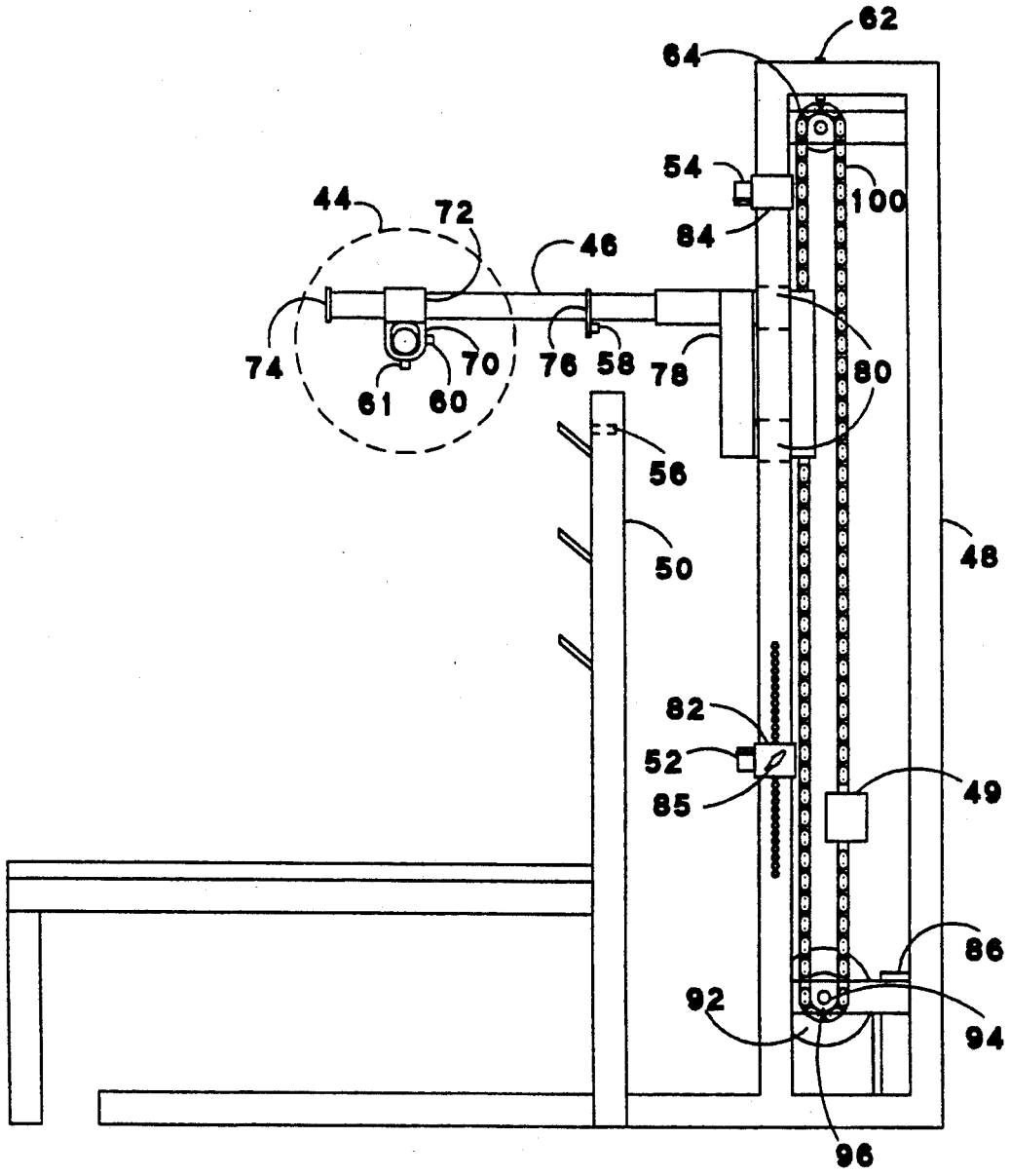
FIG. 2 is side view of a second embodiment of a weightlifting apparatus of the present invention.
Figure 3:
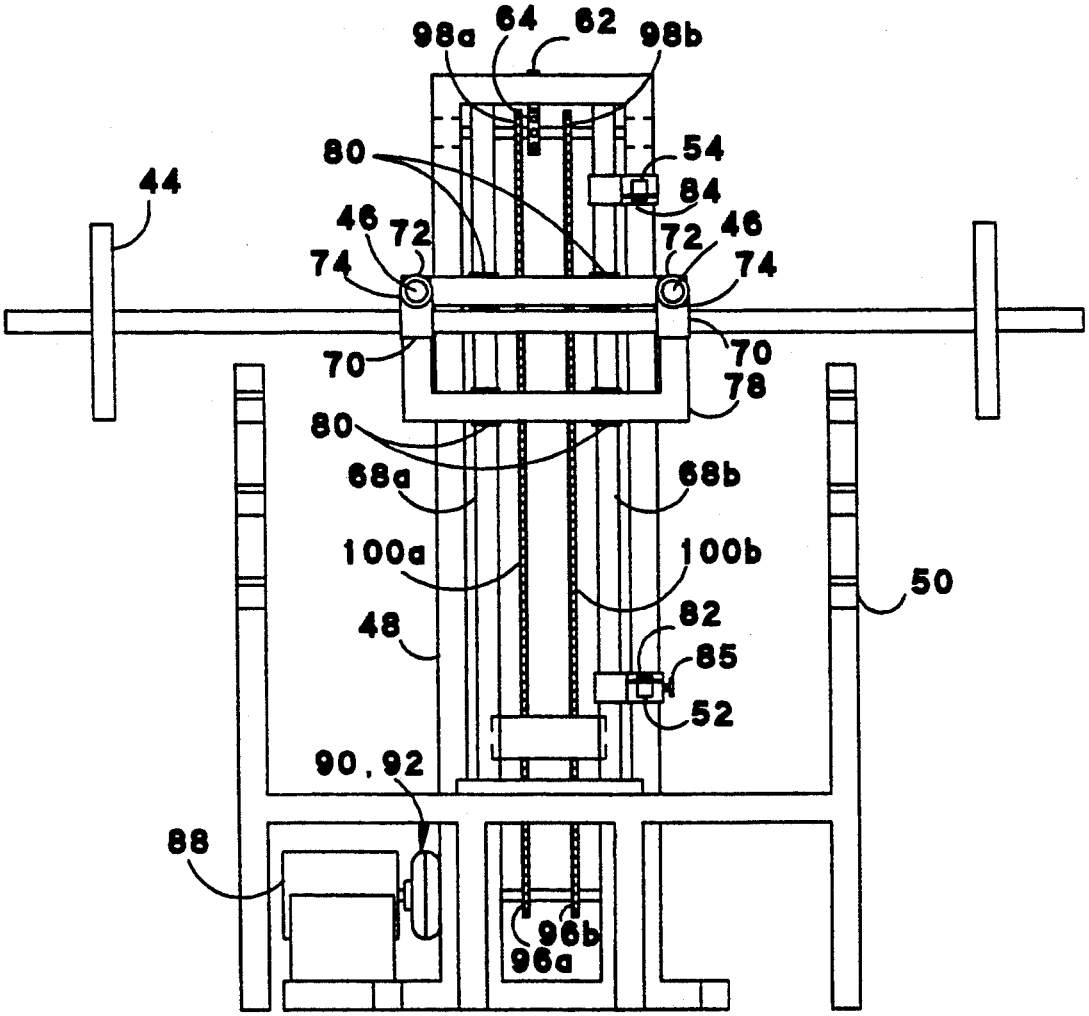
FIG. 3 is a front view of the components of the weightlifting apparatus shown in FIG. 2.

FIGS. 2 and 3 show an alternate embodiment of the weightlifting apparatus of the present invention. FIG. 2 shows a side view of a barbell 44, a spotting arm shaft 46, a vertical support frame 48, a counterweight 49, a rack 50, and numerous sensors. The sensors include a lower sensor 52, an upper sensor 54, a rack sensor 56, an arm sensor 58, a holding collar position sensor 60, a weight sensor 61, and a speed sensor 62.

Lower sensor 52 and upper sensor 54 detect the relative presence of arm support 78 at different positions. Arm sensor 61 detects the relative presence of holding collars 70 adjacent to arm sensor 61. Holding collar position sensor 60 detects the relative presence of the barbell in the lower portion of holding collar 70. Weight sensor 61 detects the relative amount of weight supported by the holding collar 70.

As shown in FIG. 3 the speed sensor 62 cooperates with the wheel 64 to output a signal representative of the speed of the wheel 64. The wheel 64 contains several evenly spaced holes in the surface along its perimeter. Speed sensor 62 is directed towards the surface of this perimeter such that the holes pass by the sensor 62 as the wheel 62 rotates. The rate at which the holes in the wheel 64 pass by the speed sensor 62 is representative of the speed of the wheel 64 and hence the speed at which the barbell 44 is moving up and down the vertical shafts 68*a* and 68*b*.

The holding collars 70 are free to move along the spotting arm shaft 46 via support bearings 72 between an end stop 74 and a rack stop 76. When the holding collars 70 are directly above the rack 50, the arm sensor 58 outputs a signal representative of the presence of the holding collars 70 at this position. When the barbell 44 is on the rack 50, the rack sensor 56 outputs a signal representative of the presence of the barbell 44 at this position.

The arm support 78 moves along the vertical shafts 68 via the spotting bearings 80 between a lower stop 82 and an upper stop 84. Lower stop 82 and upper stop 84 are magnetically attached to vertical support frame 48. The magnetic strength of each of the respective stops 82 and 84 is such that the weight of each stop is not sufficient to overcome the attractive force of each stop. The respective attractive forces, however, should be able to be overcome with the aid of a relatively small amount of additional force.

Thus, during initialization, lower stop 82 and upper stop 84 are first positioned adjacent to the arm support 78. The user then moves the barbell 44 up and down in the same motion as will be used to lift the weight. This movement repositions stops 82 and 84 to the appropriate respective lower and upper stop locations. Lower sensor 52 is mounted on, and moves with, the lower stop 82, and upper sensor 54 is mounted on, and moves with, the upper stop 84. Lower stop 82 is then locked into place by placing a pin 85 through the closest hole in vertical shaft 68*b*. This prevents the barbell 44 from falling past the lower stop 82 and thus protects the user.

When the arm support 78 is at the lower stop 82, the lower sensor 52 outputs a signal representative of the presence of the arm support at this position. Similarly, the upper sensor 54 outputs a signal representative of the presence of the arm support 78 at the upper stop 84.

All of the sensor outputs are connected to a control unit 86, which includes a microprocessor in the present embodiment. The microprocessor is connected to the power assist unit which includes a motor 88, a clutch 90, and a brake 92. Alternatively, the power assist unit could include hydraulic devices. The motor 88 is connected through the clutch 90 to the lower shaft 94 which drives the lower sprockets 96*a* and 96*b*. The lower sprockets 96*a* and 96*b* are coupled to the upper sprockets 98*a* and 98*b* by chains 100*a* and 100*b*, respectively. The arm support 78 is connected to the chains 100 such the arm support 78 moves together with the chains 100.

Figure 4:
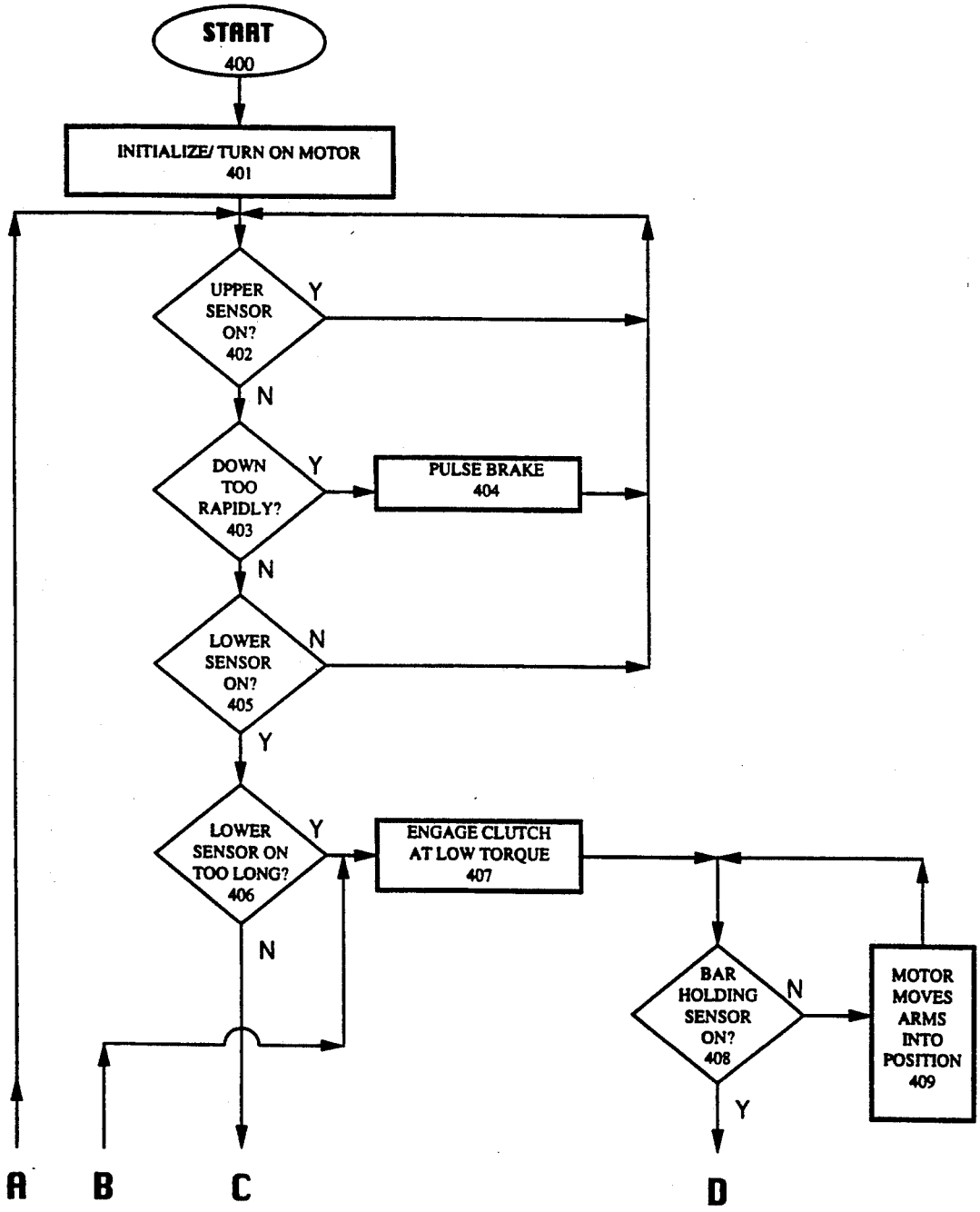
FIGS. 4(A)–4(C) show a flow chart of steps performed by the controller in an embodiment of the invention.
Figure 4:
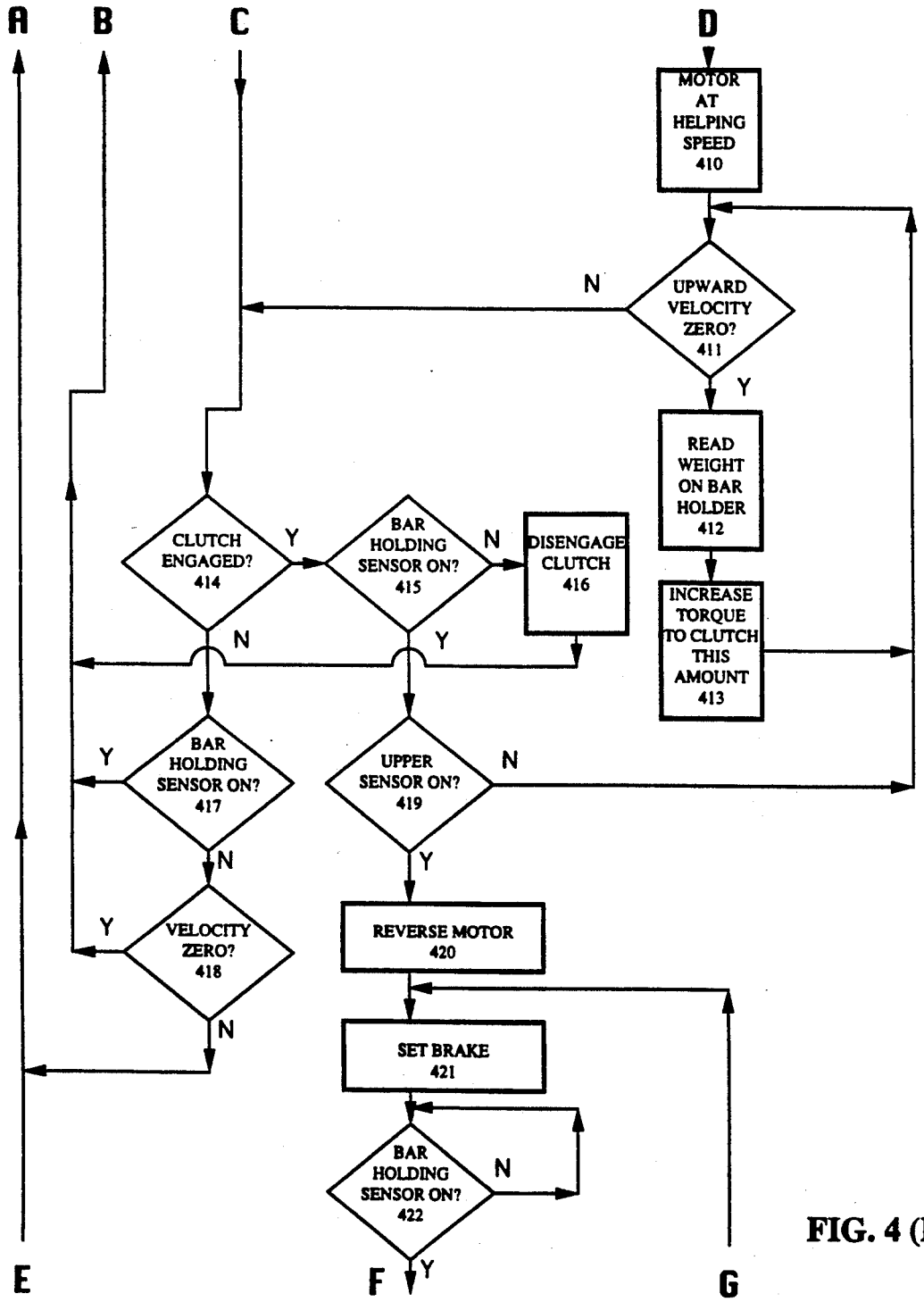
Figure 4:
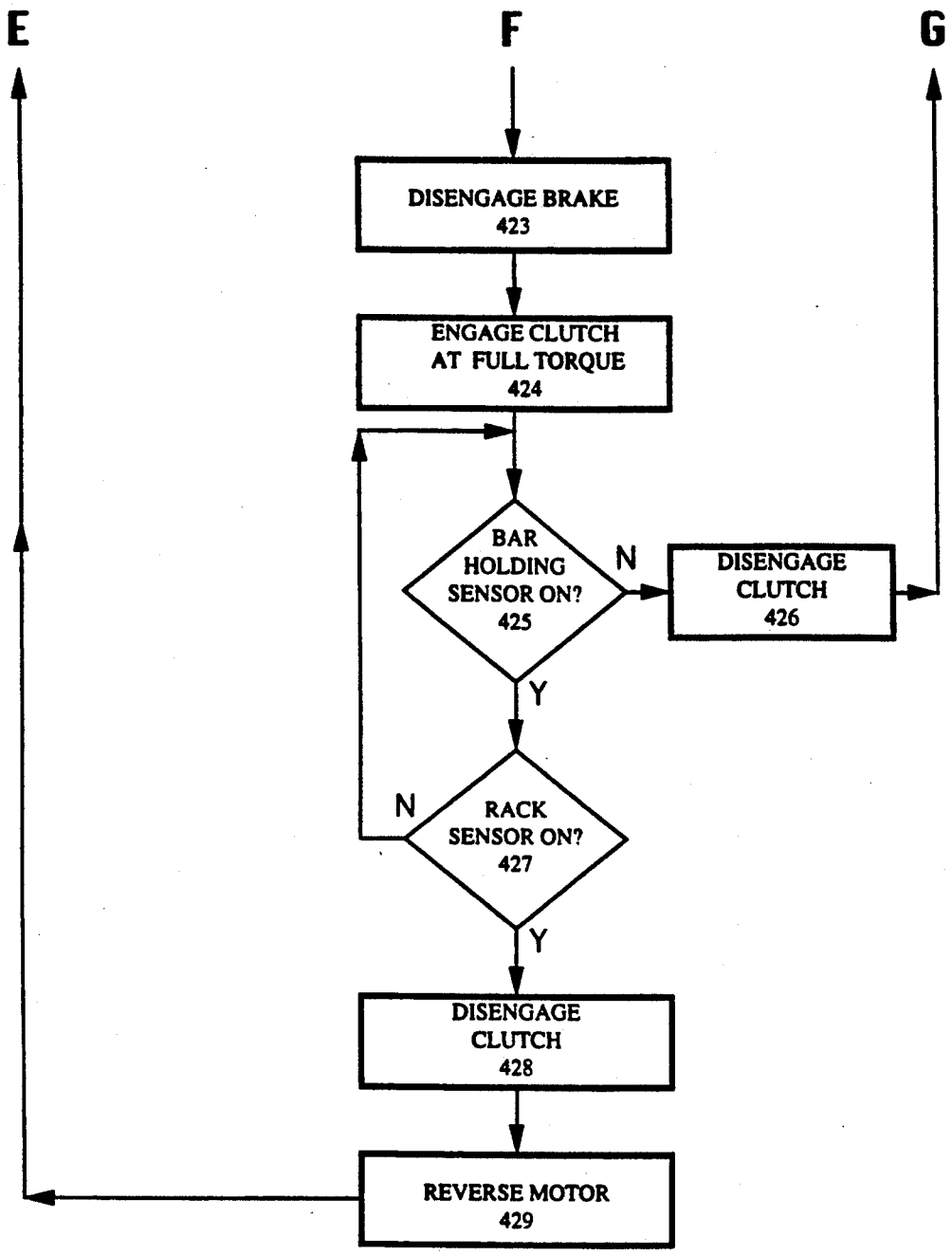

FIGS. 4(A)–4(C) show a flowchart illustrating an exemplary operational mode of the control unit 86 which controls the motor 88, the clutch 90 and the brake 92 responsive to all of the sensor outputs. Before use commences, the lower and upper stops 82 and 84 must be positioned as described above, and the barbell 44 must be placed on the rack 50 such that rack sensor 56 is activated.

Use begins with the initiation of a start command (step 400). Once started, the system is initialized by turning the motor 88 on, releasing the brake 92 and disengaging the clutch 90 (step 401).

A decision is made (step 402) whether the upper sensor is on. If it is on then the program waits until the upper sensor 54 is turned off. Once the upper sensor 54 is turned off, a decision is made (step 403) whether the barbell 44 is descending too rapidly. The speed is determined from the output of the speed sensor 62. If the speed is too fast, then the brake 92 is pulsed on for a short period of time (step 404), for example 1/10 second.

Next a decision is made (step 405) whether the barbell 44 is at the lower stop 82 (whether the lower sensor 52 is activated). If lower sensor 52 is not activated, then the program cycles back through steps 402 and 403 (and possibly 404) until the lower stop 82 is activated indicating that the barbell is at the low point. Once the lower stop has been activated a timer begins to clock the length of time the barbell has been at the low position. If the barbell has not been there more than a predetermined period of time then the program continues to step 414.

If the barbell has been at the low point for too long, then the program continues to step 407 which causes the clutch to be engaged with the motor. A decision is then made (step 408) whether the holding collar sensor 60 is activated. If the sensor 60 is deactivated, then the motor is adjusted to run at high speed (step 409). The motor remains at high speed until the sensor 60 becomes activated. When the holding collar sensor 60 is activated, then the program continues to step 410 which causes the motor to be adjusted to run at low speed. A decision is next made (step 411) whether the barbell is moving at all, or whether it is standing still.

If the barbell is not moving, then a signal representative of the gravitational weight of the weight being lifted is produced by the weight sensor 61 (step 412). The weight sensor 61 is a strain gauge sensor in the present embodiment. The relative engagement of the clutch 90 is then adjusted responsive to the output of the weight sensor 61 such that the greater the weight on the holding collars, the greater degree to which the clutch is engaged (step 413). Incremental assistance is thus provided to the user in lifting the barbell.

If the barbell is not moving (in step 411 above) then the program proceeds to step 414 where a decision is made whether the clutch is engaged. If the clutch is not engaged then decisions are made whether the holding collar sensor 60 is activated (step 417) and whether or not the barbell is moving (step 418). If either the holding collar sensor 60 is activated, or the barbell is not moving, then the program proceeds to step 407 where the clutch is caused to be engaged to assist the weightlifter as described above.

If the holding collar sensor 60 is not activated (step 417) and the barbell is moving (step 418) then the program cycles back to step 402.

If the clutch is engaged at step 414, then a decision is made whether the holding collar sensor 60 is activated (step 415). If the sensor is not activated then the clutch is disengaged and the program cycles back to step 402. If the holding collar sensor 60 is activated, then a decision is made whether upper sensor 54 is activated (step 419). If upper sensor 54 is not activated, then the program proceeds to step 410 where the motor is adjusted to operate at low speed and assistance is incrementally provided as needed as detailed above in steps 411–413.

If upper sensor 54 is activated in step 419 above, then the program proceeds to steps 420–429 as follows. At this point the clutch is engaged (step 414) and the holding collar sensor 60 will be activated (step 415). In step 420 the motor is reversed, and in step 421 the brake is applied. The program then waits until the holding collar sensor 60 is activated (step 422).

Once the barbell is resting in the holding collar (sensor 60 is activated), then the brake is released (step 423) and the clutch is engaged (step 424). The barbell is now being lowered by the motor turning in the reverse direction. If the holding collar sensor 60 is deactivated then the clutch is disengaged (step 426) and the program cycles back to step 421 where the brake is set. If the holding collar sensor 60 remains activated, then the program waits (step 427) until the barbell is resting on the rack 50 (as determined from the output of rack sensor 56). The program cycles back to step 425 until the rack sensor 56 is activated, at which point the program proceeds to steps 428 and 429 where the clutch is disengaged (step 428) and the motor is again reversed (step 429). The program then cycles back to step 402.

If assistance is never required the program will repeatedly cycle through steps 402, 403, 405, 406, 414, 417 and 418. If assistance is provided then the assistance may be provided to a varying degree depending upon the speed of the motor and the extent to which the clutch is engaged. If assistance is not required immediately after having been provided, then the clutch disengages the motor and assistance is withdrawn. The user thus has intermittent assistance available in varying degrees depending on his or her needs at all times. The controller responds to the needs of the user almost instantly with use of the microprocessor. The microprocessor allows output capabilities including printouts and screens displays which indicate the amount of assistance provided by the machine (i.e., weight lifted at various times during various intervals).

In alternative embodiments the weight sensors might communicate directly with a motor if a clutch is not used. In further alternative embodiments the exercise may be achieved through having a user repeatedly lower weights from a height, and the apparatus of the invention might assist in the lowering of the weights.

In light of the foregoing, those skilled in the art will now appreciate the many advantages made possible by the present invention. These advantages include an automated monitoring system with sensors, an assisting unit for lifting and/or for braking, and a control unit for controlling the assisting unit responsive to the outputs of the sensors. The power assist weightlifting apparatus of the invention, therefore, provides variable intermittent assistance for a user, yet does not require a user to be accompanied by a spotter.

What is claimed is:

1. A weightlifting apparatus for providing spotting assistance to a weightlifter, said apparatus comprising:

a support structure including a first support arm attached to said support structure and a first bar spotting unit attached to said support arm, wherein said bar spotting unit is adapted to receive a weightlifting bar such that the bar may be moved from a lower position within said bar spotting unit to an upper position within said bar spotting unit;

position sensor means associated with said bar spotting unit for providing a lower position output signal indicative of the presence of said bar at said lower position;

weight sensor means for producing a weight output signal indicative of the gravitational force exerted by the weightlifting bar on said spotting unit;

assisting means for providing lifting assistance to the weightlifter; and control means for controlling said assisting means responsive to said lower position output signal.

2. A weightlifting apparatus as claimed in claim 1, wherein said apparatus further includes speed sensor means for producing a speed output signal indicative of the speed of movement of said support arm along a vertical portion of said support structure, wherein said control means controls said assisting means responsive to said speed output signal.

3. A weightlifting apparatus as claimed in claim 1, wherein said spotting unit is relatively free to move within a horizontal range of movement along said support arm.

4. A weightlifting apparatus as claimed in claim 1, wherein said support arm is slidable between a bottom position and a top position along a vertical portion of said support structure, and wherein said apparatus further includes yieldably securable magnetic top and bottom position sensors.

5. A weightlifting apparatus as claimed in claim 1, wherein said apparatus further includes a second support arm and a second bar spotting unit attached to said second support arm, said second bar spotting unit being adapted to receive the weightlifting bar.

6. A weightlifting apparatus as claimed in claim 1, wherein said control means controls said assisting means to provide variable amounts of assistance responsive to said weight sensor output signal.

7. A weightlifting apparatus as claimed in claim 2, wherein said assisting means further includes a breaking means for slowing the movement of said first support arm responsive to the output of said speed sensor output signal.

8. A weightlifting apparatus for providing spotting assistance to a weightlifter, said apparatus comprising:

a support structure including a first support arm attached to said support structure and a first bar spotting unit attached to said support arm, wherein said bar spotting unit is adapted to receive a weightlifting bar such that the bar may be moved from a lower position within said bar spotting unit to an upper position within said bar spotting unit;

position sensor means associated with said bar spotting unit for providing a lower position output signal indicative of the presence of said bar at said lower position;

a weightlifting bar storage rack for storing the bar when not in sue, an storage rack position sensor means for producing a rack position output signal indicative of the presence of said bar on said bar storage rack;

assisting means for providing lifting assistance to the weightlifter; and control means for controlling said assisting means responsive to said lower position output signal.

9. A weightlifting apparatus for providing spotting assistance to a weightlifter, said apparatus comprising:

a support structure including a first support arm attached to said support structure and a first bar spotting unit attached to said support arm, wherein said bar spotting unit is adapted to receive a weightlifting bar such that the bar may be moved from a lower unsafe area within said bar spotting unit to an upper safe area within said bar spotting unit;

weight sensor means associated with said bar spotting unit for producing a weight output signal indicative of the gravitational force exerted by the weightlifting bar on said spotting unit within said lower unsafe area;

assisting means for providing lifting assistance to the weightlifter; and control means for controlling said assisting means responsive to said weight sensor output signal such that said assistance is terminated if said bar is in said upper safe area.

10. A weightlifting apparatus for providing spotting assistance to a weightlifter, said apparatus comprising:

a support structure including a support arm slidable along said support structure, and a bar spotting unit attached to said support arm, wherein said bar spotting unit is adapted to receive a weightlifting bar such that the bar may be moved from a lower unsafe area within said bar spotting unit to an upper safe area within said bar spotting unit;

speed sensor means for producing a speed output signal indicative of the speed of movement of said support arm along a vertical portion of said support structure;

weight sensor means associated with said bar spotting unit for producing a weight output signal indicative of the gravitational force exerted by the weightlifting bar on said spotting unit;

position sensor means associated with said bar spotting unit for providing a lower unsafe area output signal indicative of the presence of said bar at said lower position;

assisting means for providing lifting assistance to the weightlifter; and control means for controlling said assisting means responsive to said position, speed and weight sensor output signals, wherein said assistance is initiated responsive to said speed sensor output signal, the amount of said assistance is adjusted responsive to said weight sensor output signal, and said assistance is terminated if said bar is in said upper safe area.

11. A weightlifting apparatus as claimed in claim 9, wherein said apparatus further includes a data output means for providing information to the weightlifter relating the assistance provided by said assisting means.

* * * * *